United States Patent [19]

Goldfarb

[11] Patent Number: 4,504,889

[45] Date of Patent: Mar. 12, 1985

[54] COMPACT, PERSONAL-SECURITY FLASHLIGHT WITH HIGH-INTENSITY UNIFORM WIDE BEAM

[76] Inventor: Adolph E. Goldfarb, 1432 S. East Wind Cir., Westlake Village, Calif. 91361

[21] Appl. No.: 566,049

[22] Filed: Dec. 27, 1983

[51] Int. Cl.[3] ..... F21L 7/00

[52] U.S. Cl. ..... 362/200; 362/186; 362/202; 362/205; 362/328; 362/329; 362/339; 362/347

[58] Field of Search ..... 362/200, 202, 205, 186, 362/347, 328, 329, 339

[56] References Cited

U.S. PATENT DOCUMENTS 4,237,526 12/1980 Wood ..... 362/267 X 4,237,527 12/1980 Breedlove ..... 362/189

4,241,332 12/1980 Farque ..... 362/186 X

*Primary Examiner*—Stephen J. Lechert, Jr.

*Attorney, Agent, or Firm*—Romney, Golant, Martin & Ashen

[57] ABSTRACT

Although small enough to fit in a purse, this flashlight operates on six volts using a full-size flashlight bulb and casts a bright and quite-uniform beam of light, primarily for brief uses at relatively short range.

The uniformity of the beam is obtained by a novel optical system, that includes an unsilvered, preferably generally parabolic reflector and a beam-narrowing lens. The combination of compactness and brightness is obtained by novel arrangement of the bulb and four penlight cells within the battery case, enhanced by the geometry of the reflector and lens.

20 Claims, 6 Drawing Figures

Fig. 2.
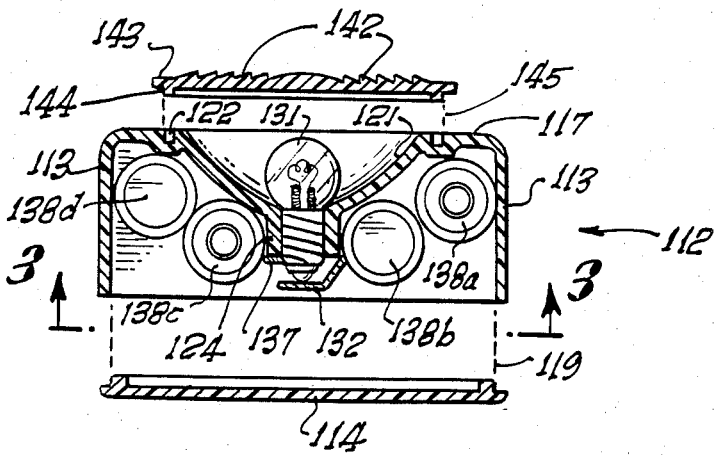
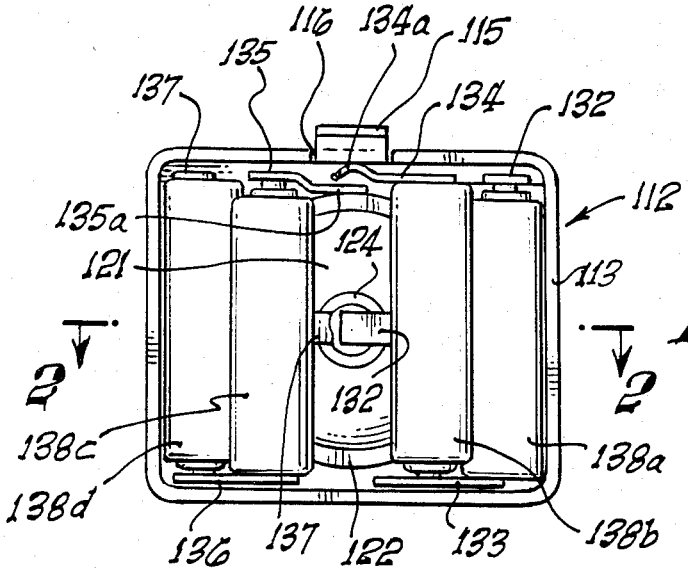
Fig. 3.

COMPACT, PERSONAL-SECURITY FLASHLIGHT WITH HIGH-INTENSITY UNIFORM WIDE BEAM

BACKGROUND

1. Field of the Invention

This invention relates generally to flashlights, and more particularly to special-purpose personal-security flashlights tailored to repetitive use for short intervals when the user wishes to inspect an about-to-be-entered car, front porch, or other relatively small area at relatively close quarters. The invention further particularly relates to flashlights that are sufficiently compact to be carried in a purse.

2. Prior Art

Standard six-volt flashlights are impractical for personal-security use as just described, for two reasons. First, they are far too large and heavy.

Second, they cast a beam of light that is narrowly constrained—usually by a silvered, shaped reflector behind the flashlight bulb—so as to illuminate an area the size of a person at, say, forty to sixty feet. Such a beam is too narrow for ready use at close range to determine at a glance whether a person is present in the area of interest, because it only illuminates a small part of a person at close range. By "close range" I mean, for example, four to fifteen feet, or twenty feet at the most. At close range such a narrow beam must be played about the area of interest while looking carefully to visually integrate the information returned.

Another disadvantage of such a beam is that the internal components of the bulb are often imaged by the reflector at some distance from the flashlight, so that shadows are projected forwardly with the beam. These shadows of the filament and other internal bulb parts are often confusing or at least distracting.

The bright, narrow "flare" area of such a standard-flashlight beam is surrounded by a much wider cone of "wash" light. This part of the beam results primarily from the light emanating in a forward direction from the bulb directly—that is to say, not reflected by the reflector behind the bulb. This wider cone, however, is much too dim to be effective, especially because the contraction of the human iris in response to the bright central flare renders the eye insensitive to the information picked up in the "wash" part of the light beam.

Thus standard full-power flashlights are unsuited for examining close quarters about to be entered. A great variety of purse-size flashlights has been introduced in attempts to satisfy the demand for such effective personal precautions. Needless to say, modern urban conditions have enormously increased this demand.

Some of these miniature flashlights are of the well-known "penlight" type—a small bulb, generally two or at most three penlight batteries, and virtually no effective reflector. More-recently introduced models are of a flattened, broader shape only slightly larger than a cigarette pack, with the light and a small reflector on the end or at a corner. These miniature lamps of course overcome the drawbacks of size and weight mentioned earlier. None of these small flashlights, however, is effective in meeting the demand. The reasons are that they are all underpowered, or have undersized light collector/reflectors, or more commonly both—and consequently cast a beam of light that is far too dim to be of real use—and furthermore they are like the full-size lamps in that they cast a beam that is too narrow.

BRIEF SUMMARY OF THE DISCLOSURE

My invention provides a flashlight that is readily small enough to fit in a purse, but that operates on a full six volts using a full-size flashlight bulb, and collects and uses much more of the light from this bulb than do most flashlights. It thereby casts a beam of light that is correspondingly brighter than the beam from other small flashlights.

Unlike the beam from standard-size flashlights, however, the beam from the flashlight of my invention is also quite broad and quite uniform, for effective illumination, at relatively short range, of an area to be entered.

The uniformity of the beam is obtained by a novel optical system, that includes an unsilvered, white- or light-color-painted, diffuse-reflecting generally parabolic reflector and a beam-narrowing lens. The use of a diffuse-reflecting, generally parabolic reflector—specifically, one that is not silvered—makes particularly beneficial use of the collecting and generally forwardly-redirecting properties of a parabolic or generally parabolic surface.

These advantages, however, are enjoyed without incurring the conventional-reflector disadvantages of (1) projecting most of the light as an overly narrow "flare" portion of the beam or (2) reproducing in the projected beam the internal structural of the filament and other parts inside the bulb. At the same time the surface efficiency of the reflector is advantageously made very high by using a high-reflectance flat white (or other light color) surface. This surface may be, for instance, a paint or like surface coating, or a molded, uncoated surface of suitable plastic material.

The combination of compactness and brightness is obtained by novel arrangement of the bulb and four penlight cells within the battery case, enhanced by the geometry of the reflector and lens.

More specifically, the case is formed essentially as a flat, generally square shape, with the reflector facing toward a square (or nearly square) face of the case rather than toward a side or top face. The reflector diameter at the point where the paraboloid intersects the surface of the case is only slightly smaller than the length of the side of the square—that is, the lateral or vertical dimension of the case itself. Thus the reflector can be as large as practically compatible with the external dimension of the case.

Moreover, the thickness of the case (that is, the case dimension normal to the square surface) in one embodiment is advantageously made only slightly larger than the length of the bulb; and the reflector extends only slightly forward of the front tip of the bulb. In other words, the degree to which the case can be "flattened" is controlled by the bulb length. By making the case only slightly thicker than the bulb length, I provide the slimmest possible overall product compatible with use of a full-size, full-voltage flashlight bulb in this novel configuration.

This slender profile can be provided without sacrificing ability to position four penlight cells inside the case behind the reflector: the cells advantageously may be located in a staggered geometry that will be discussed. This geometry does add slightly to the width or height of the flashlight case, but need not add to both; thus the flashlight case may be slightly rectangular rather than square. By making the reflector extend slightly forward of the front tip of the bulb, I provide a reflector that collects light from the filament over a solid angle that considerably exceeds half of a full sphere.

In another embodiment the four penlight cells may be placed in a slightly more orderly-looking configuration (rather than staggered), and the outside of the case may be made square (rather than rectangular), but at the expense of adding about three-eighths of an inch to the thickness of the case. I consider both of these embodiments satisfactory, the second providing a case that is only slightly thicker but perhaps more appealing to the user.

Electrical connections within the flashlight are made by metallic strips fastened to the interior walls of the case. These strips are advantageously interrupted at one point, behind and in conjunction with a deformable section of the case, to form a momentary switch for use in activating the light.

I prefer a momentary switch, in view of the special-purpose character of the flashlight of my invention, to maximize battery life. The special purpose is to provide a light for only brief occasional use at night when the user is about to enter a car or some other confined area in which personal security may be questionable. Generally speaking there is no need to use such a light for constant illumination, so a momentary switch suffices.

If desired, however, the flashlight provided in accordance with my invention can be fitted with a toggle or slide switch (in addition to the momentary switch) for use in unusual or unforeseen situations in which constant illumination is desired. A less-expensive arrangement for accomplishing the same purpose is a locking pin, bar, or plate that is pivotally or slidably mounted to the flashlight case in such a way that it can be moved into a position in which it holds in the momentary switch. I have found that the four penlight batteries and standard bulb described here are capable of producing a reasonably strong beam of light for around three hours.

All of the foregoing operational principles and advantages of the present invention will be more fully appreciated upon consideration of the following detailed description, with reference to the appended drawings, of which:

BRIEF DESCRIPTION OF THE DRAWINGS

FIG. 2 is a cross-sectional side elevation of the same embodiment, taken through the center of the case.

FIG. 3 is an elevation of the same embodiment from the rear, showing the arrangement of the batteries and other parts as seen by a user desiring to change the batteries. FIG. 3 is taken along the line 3—3 in FIG. 2; and FIG. 2 is taken along the line 2—2 in FIG. 3.

FIG. 5 is taken along the line 5—5 in FIG. 4; and FIG. 4 is taken along the line 4—4 in FIG. 5.

DETAILED DESCRIPTION OF THE PREFERRED EMBODIMENTS

Figure 1:
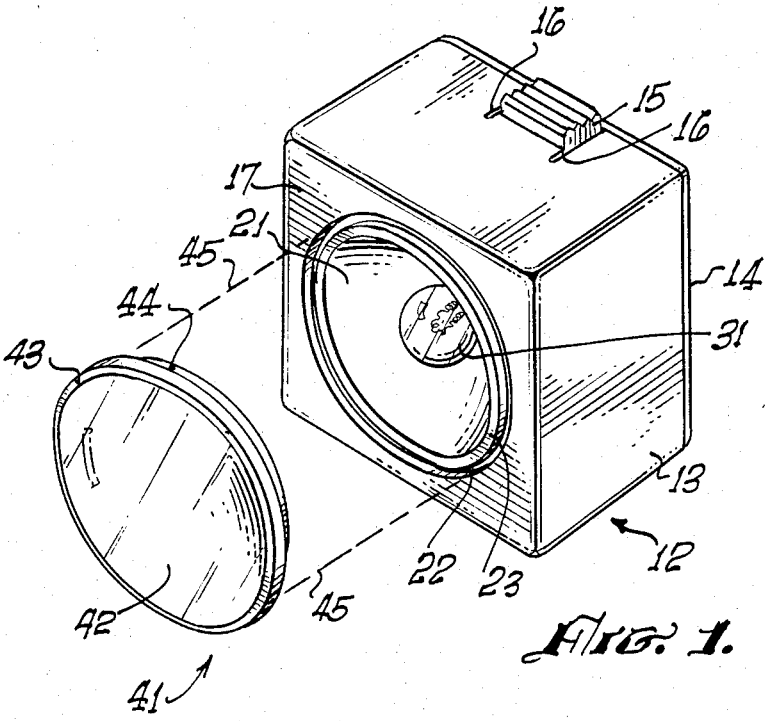
FIG. 1 is a isometric exterior view of a flashlight according to one preferred embodiment of my invention, with the lens shown removed to expose the reflector and bulb.
Figure 6:
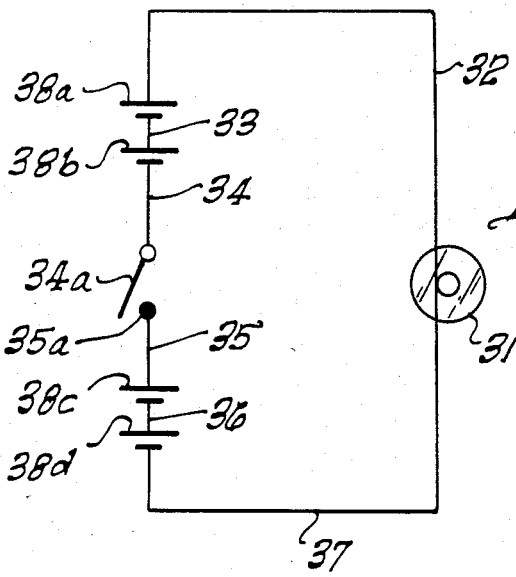
FIG. 6 is an electrical schematic of the invention.

FIG. 1 shows the general arrangement of exterior features. The flashlight occupies (with the exception of one feature to be mentioned below) a case 12, which has relatively shallow side walls 13 and a very generally square face 17. The dimensions of the face 17 are substantially greater than the depth (front-to-back dimension) of the side walls 13.

The case has a rear cover 14, and carries a preferably knurled power button 15, which is simply a glued-on or integral enlargement of a small portion of the top wall of the case. Slots 16 at the two sides of the power button 15 permit vertical motion of the button to activate the light.

Formed in the front surface of the face 17 is a parabolic, or very generally parabolic, recessed reflector 21. The reflector 21 is a figure of revolution, so that it intersects the plane of the front face 17 in a circle. Surrounding this reflector is a very shallow circular slot 22, also formed in the face 17. Between the forwardmost annular area of the reflector 21 and the slot 22 there is preferably (for strength) formed a narrow ridge 23 that is substantially coplanar with the face 17.

Screwed into a hole (not illustrated in FIG. 1) at the rear of the reflector 21 is a full-size flashlight bulb 31. The forwardmost part of the bulb 31 is only very slightly rearward of the face 17, so that no unnecessary thickness of the overall device is wasted in unused space forward of the bulb 31.

Fitted to the face 17 is a lens 41. On the rear surface of the lens 41 is a ridge 44 which projects rearwardly from the lens 41 and fits into the circular slot 22 in the face 17. The lens 41 is moved into position against the face 17, with the ridge 44 sliding into the slot 22, along lines of motion 45. Slight friction between the slot 22 and the mating ridge 44 then retains the lens 41 in position, but permits lens removal for changing of the flashlight bulb. An optional flange 43 at the periphery of the lens 41 helps keep dirt out of the space between the lens 41 and the reflector 21.

To minimize overall thickness of the device, the lens may be a Fresnel lens. If so, the lens may be formed as sections of either a simple double-convex or a plano-convex Fresnel lens, since the rearward convexity of a Fresnel lens does not add significant rearward thickness. For lesser expense in a short-run production operation, the lens could instead be a simple plano-convex type with the planar surface facing rearward to avoid interference with the bulb.

FIGS. 2 and 3 show a preferred embodiment of the invention that is related to the general illustration of FIG. 1. The case 112 in the embodiment of FIGS. 2 and 3 is somewhat elongated in the lateral (left-to-right) dimension, to permit an internal arrangement of parts that yields somewhat less overall thickness of the case (i.e., length of the side walls 113). Thus the face 117 is slightly rectangular rather than square. Otherwise the exterior parts shown in FIGS. 2 and 3 are substantially the same as the correspondingly numbered parts (except for the lack of prefix numeral "1") in FIG. 1.

As FIG. 2 shows, the flashlight case is preferably formed as a unitary plastic molded shell, with roughly uniform thickness for all the walls—including the portion behind the slot 122, and also including the reflector 121. The inwardmost end of the reflector 121 is continuous with a similarly molded, generally cylindrical portion 124 which fits closely around the base of the light bulb 131. While generally cylindrical this portion 124 is slightly tapered to allow a "draft" for molding. The forward surface of the reflector itself may be coated with a highly reflective, diffuse-reflecting (that is to say, "flat") paint; or the surface may be uncoated if the plastic or like material of the cast shape is suitably light colored and diffuse reflecting. From the point of view of performance, a white reflector is best—but the use of another light color, such as very light blue, is within the scope of my invention.

Now referring to both FIGS. 2 and 3, within the case 112 are four flashlight batteries 138*a* through 138*d*, in a very compact staggered arrangement. This arrangement leaves the length of the bulb 131 as the limiting determinant of the overall thickness of the case. Also within the case 112 are six metal strips, fastened by conventional means (not illustrated) to the interior of the case walls, for making connections between the batteries 138*a–d* and the bulb 131.

Metal strip 132 makes a connection between the central tip contact at the rear of the light bulb 131 and the positive terminal at the top end of the first battery 138*a*. (To avoid confusion in the drawings, the latter part of this connector 132 is omitted from FIG. 2, and the intermediate path of this connector is omitted from both FIGS. 2 and 3.) Metal strip 133 makes a connection between the negative terminal at the bottom of the first battery 138*a* and the positive terminal at the bottom of the second battery 138*b*. Metal strip 134 makes a connection to the negative terminal at the top of the second battery 138*b*, and also forms the movable contact 134*a* of a power switch.

Metal strip 135 forms the stationary contact 135*b* of the switch, and makes a connection to the positive terminal at the top of the third battery 138*c*. Metal strip 136 connects the negative terminal at the bottom of that battery with the positive terminal at the bottom of the fourth battery 138*d*. Finally, metal strip 137 interconnects the negative terminal at the top of the fourth battery 138*d* with the threaded side of the light-bulb base, and also forms a stationary thread at the base of the cylindrical section 124 for mating with the thread of the bulb base.

In the preferred embodiment just discussed, the face 117 may be about 2.7 inches wide by about 2.3 inches tall, and the case thickness (front-to-back length of the side 113) may be about 1.1 inch.

Figure 5:
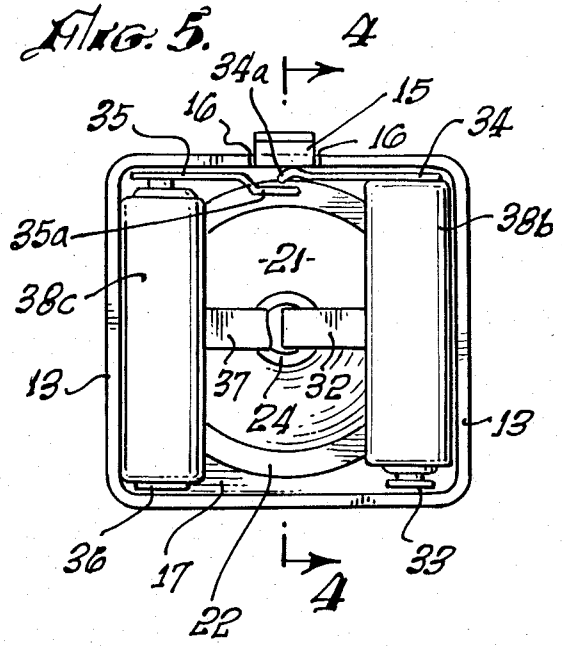
FIG. 5 is an elevation view, similar to that of FIG. 3, but taken of the FIG. 4 embodiment.
Figure 4:
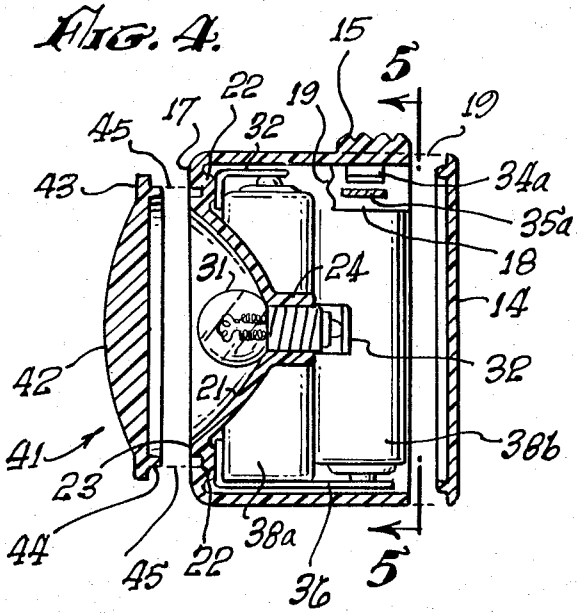
FIG. 4 is a cross-sectional side elevation, similar to that of FIG. 2, but of another preferred embodiment that is slightly thicker.

FIGS. 4 and 5 illustrate another preferred embodiment of the invention, even more closely related to the general illustration of FIG. 1 than is the embodiment of FIGS. 2 and 3. Accordingly the exterior components of FIGS. 4 and 5 are numbered identically with the features of FIG. 1. The case 12 in the embodiment of FIGS. 4 and 5 is not elongated but rather is square. Thus at least one dimension of the face of the flashlight can be roughly three-eighths of an inch shorter than in the embodiment of FIGS. 2 and 3; however, the case is roughly five-sixteenths to three-eighths of an inch thicker.

FIG. 4 shows that the case and other components are otherwise formed similarly to those of the previously discussed embodiment—namely, as a unitary plastic molded shell, with roughly uniform thickness for all the features. Since the internal features are essentially the same in form and function as those of FIGS. 2 and 3, the internal parts are numbered to correspond with the numbers used in FIGS. 2 and 3, except for omission of the prefix "1". The detailed description given for FIGS. 2 and 3 may be considered to apply equally here, making due allowance for the absence of the prefix numeral "1" from the components in FIGS. 4 and 5—with just one difference.

That difference is that the four flashlight batteries 38*a* through 38*d*, are arranged in two straight-front-to-back rows of two each, one row at each side within the case. That is to say, batteries 38*a* and 38*b* (FIG. 4) are positioned along the right side of the case (as seen from the rear—see battery 38*b* in FIG. 5), one directly in front of the other; while batteries 38*c* and 38*d* form another row at the left side of the case (see battery 38*c* in FIG. 5). This arrangement makes twice the diameter of a single battery (rather than the length of the bulb 31) the limiting determinant of the overall thickness of the case.

In this embodiment the face 17 may be about 2.3 inches square, and the case thickness may be about 1.4 inch.

In the preferred embodiment of FIGS. 4 and 5, tip of the lens 42 is approximately seven-sixteenths inch forward of the face 17 of the case. At this point the diameter of the projected light beam is just over two inches. The beam diverges at a half-angle of approximately 28.3 degrees, and consequently illuminates an area about six feet in diameter at a distance of about five and a half feet. A standing person, middlingly tall, thus is plainly illuminated head-to-toe at a range of only five and a half feet, without any need to play the beam about and mentally "fit together all the pieces" of the person as is necessary with a conventional flashlight beam.

Of course some variation in the divergence of the beam is acceptable without departing from my invention. For instance a beam six feet in diameter at a range of as little as, say, four feet and as much as perhaps twelve or fifteen feet would be acceptable. The corresponding half-angles would accordingly range from thirty-three degrees down to as little as eleven degrees. The previously mentioned half-angle of twenty-eight degrees, however, is considered optimum.

I prefer to use a parabolic or very generally parabolic reflector, for its advantage of projecting the light from the bulb generally forwardly, as already stated. Some of the benefits of my invention, however, accrue from use of an surface that is less expensive to manufacture—such as, for example, a generally conical surface—provided that such less-expensive surface does project the light from the bulb in a generally forward direction. Such less-expensive surfaces may possibly depart from a paraboloidal shape by a greater amount than could come within the terminology "generally parabolic". Accordingly, my invention may alternatively be described as using a reflector which projects the light from the bulb generally forwardly.

It is to be understood that all of the foregoing detailed descriptions are by way of example only, and not to be taken as limiting the scope of my invention—which is expressed only in the appended claims.

I claim:

1. A compact, personal-security flashlight for use with a flashlight bulb and with a flashlight battery; said flashlight comprising:

a case;

bulb-mounting means, secured within or integral within the case, for receiving such a flashlight bulb;

battery-mounting means, secured within or integral within the case, for receiving such a battery;

electrical-connection means, secured within the case, for providing a functional interconnection whereby such a bulb when received in the bulb-mounting means receives electrical power from such battery when received in the battery-mounting means; the electrical-connection means including manually manipulable switch means for repetitively establishing, interrupting, and reestablishing such interconnection;

a reflector secured to or integral with the case and having a light-colored, unmetallized, diffuse-reflecting, generally parabolic surface juxtaposed to said bulb-mounting means for collecting light from such bulb and redirecting such light forwardly;

a beam-narrowing lens secured to the case forwardly of the reflector, for forwardly projecting light from the reflector, and light directly from such bulb, in a beam that is substantially uniform.

2. A compact, personal-security flashlight for use with a standard flashlight bulb and at least four one-and-a-half-volt "penlight" batteries; said flashlight comprising:

a case;

bulb-mounting means, secured within or integral within the case, for receiving such a standard flashlight bulb;

battery-mounting means, secured within or integral within the case, for receiving such at least four "penlight" batteries;

electrical-connection means, secured within the case, for providing a functional interconnection whereby such a bulb when received in the bulb-mounting means receives electrical power from such batteries when received in the battery-mounting means; the electrical-connection means including manually manipulable switch means for repetitively establishing, interrupting, and reestablishing such interconnection;

a reflector secured to or integral with the case and having a light-colored, unmetallized, diffuse-reflecting, generally parabolic surface juxtaposed to said bulb-mounting means for collecting light from such bulb and redirecting such light forwardly; and a beam-narrowing lens secured to the case forwardly of the reflector, for forwardly projecting light from the reflector, and light directly from such bulb, in a substantially uniform beam.

3. The flashlight of claim 2 wherein:

the case is formed essentially as a flat, generally square shape;

the reflector has generally the form of a paraboloid of revolution and faces toward a square or nearly square face of the case;

the reflector diameter at the point where the paraboloid intersects the surface of the case is only slightly smaller than the length of the side of the square;

the thickness of the case is only greater than the length of the bulb by an increment that is a fraction of the bulb length; and the reflector extends only slightly forward of the front tip of the bulb.

4. The flashlight of claim 3 wherein:

the battery-mounting means receive such penlight cells inside the case behind the reflector, in a staggered geometry that is not substantially longer, in the front-to-back dimension relative to the case, than the length of such a bulb.

5. The flashlight of claim 3 wherein:

the battery-mounting means receive such penlight cells inside the case behind the reflector, one behind another in two rows of two each.

6. The flashlight of claim 2 wherein:

the lens is a plano-convex lens with the convex side facing forwardly.

7. The flashlight of claim 2 wherein:

the lens is a Fresnel lens.

8. The flashlight of claim 4 wherein:

the face of the case is approximately 2.3 inches by 2.7 inches, and the case is approximately 1.1 inch thick.

9. The flashlight of claim 5 wherein:

the case is approximately 2.3 inches square by 1.4 inch thick.

10. The flashlight of claim 1 wherein:

the beam projected forwardly diverges at a half-angle between eleven and thirty-three degrees.

11. The flashlight of claim 1 wherein:

the beam projected forwardly diverges at a half-angle between sixteen and thirty degrees.

12. The flashlight of claim 1 wherein:

the beam projected forwardly diverges at a half-angle of approximately twenty-eight degrees.

13. The flashlight of claim 2 wherein:

the beam projected forwardly diverges at a half-angle between eleven and thirty-three degrees.

14. The flashlight of claim 2 wherein:

the beam projected forwardly diverges at a half-angle between sixteen and thirty degrees.

15. A compact, personal-security flashlight for use with a flashlight bulb and a battery; said flashlight comprising:

a case;

bulb-mounting means, secured within or integral within the case, for receiving such a flashlight bulb;

battery-mounting means, secured within or integral within the case, for receiving such a battery;

electrical-connection means, secured within the case, for providing a functional interconnection whereby such a bulb when received in the bulb-mounting means receives electrical power from such battery when received in the battery-mounting means; the electrical-connection means including manually manipulable switch means for repetitively establishing, interrupting, and reestablishing such interconnection;

a reflector secured to or integral with the case and having a light-colored, diffuse-reflecting, generally parabolic surface that is juxtaposed to said bulb-mounting means and is adapted for collecting light from such bulb and redirecting such light in a generally forward direction; and a lens secured to the case forwardly of the reflector, for forwardly projecting light received by way of the reflector, and light received directly from such bulb.

16. The flashlight of claim 15, wherein:

the lens narrows the beam, and forms a beam of generally uniform intensity.

17. The flashlight of claim 15 wherein:

the reflector surface is unmetallized.

18. The flashlight of claim 16 wherein:

the reflector surface is unmetallized.

19. The flashlight of claim 15 wherein:

the lens is a plano-convex Fresnel lens.

20. The flashlight of claim 15 wherein:

the case is formed essentially as a flat, generally square shape;

the reflector has generally the form of a paraboloid of revolution and faces toward a square or nearly square face of the case;

the reflector diameter at the point where the paraboloid intersects the surface of the case is only slightly smaller than the length of the side of the square;

the thickness of the case is only greater than the length of the bulb by an increment that is a fraction of the bulb length; and the reflector extends only slightly forward of the front tip of the bulb.

* * * * *